United States Patent [19]

Shimoda et al.

[11] Patent Number: 4,594,986

[45] Date of Patent: Jun. 17, 1986

[54] FUEL SUPPLY ARRANGEMENT FOR INTERNAL COMBUSTION ENGINE

[75] Inventors: Shigeaki Shimoda; Masahiro Izuo; Yuji Nakao, all of Hiroshima; Masatoshi Shoji, Miyoshi; Masamichi Iida, Hiroshima, all of Japan

[73] Assignee: Mazda Motor Corporation, Hiroshima, Japan

[21] Appl. No.: 692,639

[22] Filed: Jan. 18, 1985

[30] Foreign Application Priority Data

Jan. 20, 1984 [JP] Japan ..... 59-9217
Jan. 20, 1984 [JP] Japan ..... 59-9218
Jan. 20, 1984 [JP] Japan ..... 59-9219

[51] Int. Cl.[4] ..... F02N 17/08; F02M 51/00

[52] U.S. Cl. ..... 123/491; 123/179 L; 123/478

[58] Field of Search ..... 123/478, 480, 486, 487, 123/491, 179 L

[56] References Cited

U.S. PATENT DOCUMENTS 4,027,641 6/1977 Moder ..... 123/179 L
4,224,913 9/1980 Barnard ..... 123/179 G X
4,499,879 2/1985 Stoltman et al. ..... 123/480
4,522,177 6/1985 Kawai et al. ..... 123/491 X

*Primary Examiner*—Tony M. Argenbright
*Attorney, Agent, or Firm*—Burns, Doane, Swecker and Mathis

[57] ABSTRACT

A fuel supply arrangement for an internal combustion engine, including an adjusting device for adjusting supply amount of fuel to the engine, an air temperature sensor for detecting temperature of intake air, a correcting device for correctively controlling the adjusting device on the basis of an output of the air temperature sensor, a detecting device for detecting a specific engine operating condition where the output of the air temperature sensor is higher than an actual temperature of the intake air, and a restricting device for restricting corrective control of the correcting device in response to a detection output of the detecting device.

21 Claims, 17 Drawing Figures

FUEL SUPPLY ARRANGEMENT FOR INTERNAL COMBUSTION ENGINE

BACKGROUND OF THE INVENTION

The present invention generally relates to an internal combustion engine (hereinbelow, referred to as an "engine") and more particularly, to a fuel supply arrangement for the engine.

Conventionally, in fuel supply arrangements for engines, it has been generally so arranged that a proper amount of fuel is supplied to the engines in accordance with amount of intake air so as to operate the engines efficiently. For example, in carburetors of the known engines, supply amount of the fuel to the engines is controlled by negative pressure of a venturi of an intake passage. On the other hand, in fuel injection devices of the known engines, the amount of intake air is detected by an air flow sensor such that injected amount of the fuel to the engines is controlled in accordance with output of the air flow sensor. However, in the case where the supply amount of the fuel to the engines is controlled by only the negative pressure of the venturi, the known carburetors have such a disadvantage that since the negative pressure of the venturi varies in accordance with flow velocity of the intake air as a parameter, an air-fuel ratio of the air-fuel mixture deviates from a preset value when a density of the intake air varies upon change of temperature of the intake air. On the other hand, in the case where the supply amount of the fuel to the engines is controlled in accordance with only the output of the air flow sensor, the known fuel injection devices have such an inconvenience that since a Karman vortex type, speed density type or vane type sensor arranged to detect volume flow rate of the intake air is usually employed for the air flow sensor, an air fuel ratio of the air-fuel mixture deviates from a preset value when a density of the intake air varies upon change of temperature of the intake air.

In order to eliminate such a drawback of the prior art fuel supply arrangements, there has been proposed a fuel supply arrangement in which an air temperature sensor for detecting temperature of intake air is provided in the course of an intake passage such that supply amount of the fuel to the engine is correctively controlled in accordance with output of the air temperature sensor as disclosed, for example, in Japanese Patent Laid-Open Publication No. 51922/1982 (Tokkaisho No. 57-51922). However, this known fuel supply arrangement is also disadvantageous in that output of the engine drops or the engine stops at the time of starting the engine in a hot state or at the time of acceleration of the engine.

In order to obviate the drawbacks of the above described known fuel supply arrangement, i.e. drop of the output of engine or stop of the engine at the time of starting the engine in the hot state or at the time of acceleration of the engine, the present inventors made thorough study and have discovered causes of the drop of the output of the engine or the stop of the engine, which will be described with reference to FIG. 1, hereinbelow. FIG. 1 illustrates changes with time of temperature a of the intake air in the intake passage, output b of the air temperature sensor for detecting the temperature a of the intake air, temperature c of cooling water of the engine and atmospheric temperature d. It will be readily seen from FIG. 1 that when the engine is started in a cold state, the air temperature sensor for detecting the temperature a (one-dot chain line) of the intake air detects the temperature a of the intake air without time lag as shown by the solid line b. Meanwhile, as shown by the solid line c, the temperature c of the cooling water of the engine rises immediately upon starting of the engine and reaches a constant value of about 80° C. Once the engine is stopped, the temperature c of the cooling water gradually drops from about 80° C. At this time, since the intake air in the intake passage is heated by the high-temperature cooling water of the engine, the temperature a of the intake air rises sharply from about 30° C., so that the sensor itself in contact with the high-temperature intake air is heated to a high temperature.

When the engine is started in such a state, i.e. in the hot state, low-temperature atmosphere shown by the broken line d is introduced into the intake passage, so that the temperature a of the intake air immediately drops to the previous temperature of about 30° C. Meanwhile, since the air temperature sensor is heated to the high temperature by the intake air at the time of stop of the engine as described above, the air temperature sensor detects the temperature a of the intake air with time lag and therefore, yields an output b corresponding to a temperature higher than the actual temperature a of the intake air. Accordingly, when the supply amount of the fuel to the engine is correctively controlled at this time in accordance with the output of the air temperature sensor, the corrective control of the supply amount of the fuel to the engine is exceedingly effected such that the supply amount of the fuel to the engine is decreased, so that the air-fuel mixture becomes excessively lean and thus, the output of the engine drops or the engine stops. Namely, the present inventors have found that the drop of the output of the engine or the stop of the engine takes place due to sudden increase of the supply amount of the intake air to the engine and time lag of detection of the air temperature sensor, which time lag of detection of the air temperature sensor is caused by the sudden increase of the supply amount of the intake air to the engine.

SUMMARY OF THE INVENTION

Accordingly, an essential object of the present invention is to provide an improved fuel supply arrangement for an internal combustion engine, which is capable of preventing drop of output of the engine or stop of the engine.

In accomplishing this object of the present invention, in a fuel supply arrangement for an internal combustion engine according to a first embodiment of the present invention, in which an air temperature sensor for detecting temperature of intake air is provided in an intake passage of the engine such that supply amount of fuel to the engine is correctively controlled on the basis of output of the air temperature sensor, a specific engine operating condition where the output of the air temperature sensor assumes a value higher than the actual temperature of the intake air is detected such that the corrective control of the supply amount of the fuel to the engine on the basis of the output of the air temperature sensor is restricted in the specific engine operating condition.

In accordance with the first embodiment of the present invention, since the corrective control of the supply amount of the fuel to the engine is restricted in the specific engine operating condition where the output of the air temperature sensor assumes the value higher than the actual temperature of the intake air, it is possible to prevent the air-fuel mixture from becoming excessively lean.

Furthermore, a fuel supply arrangement according to a second embodiment of the present invention is based on such a finding of the present inventors that when a change rate of the output of the air temperature sensor is large, the air-fuel mixture becomes excessively lean, thereby resulting in drop of the output of the engine or stop of the engine. Thus, in the fuel supply arrangement according to the second embodiment of the present invention in which the air temperature sensor for detecting the temperature of the intake air is provided in the intake passage of the engine such that the supply amount of the fuel to the engine is correctively controlled on the basis of the output of the air temperature sensor, a specific engine operating condition where the change rate of the air temperature sensor is larger than a preset value is detected such that the corrective control of the supply amount of the fuel to the engine on the basis of the output of the air temperature sensor is restricted in the specific engine operating condition, whereby the air-fuel mixture can be prevented from becoming excessively lean.

Moreover, in a fuel supply arrangement according to a third exbodiment of the present invention in which the air temperature sensor for detecting the temperature of the intake air is provided in the intake passage of the engine such that the supply amount of the fuel to the engine is correctively controlled on the basis of the output of the air temperature sensor, a specific engine operating condition where the output of the air temperature sensor assumes a value higher than the actual temperature of the intake air is detected such that the corrective control of the supply amount of the fuel to the engine on the basis of the output of the air temperature sensor is cancelled in the specific engine operating condition, whereby the air-fuel mixture can be prevented from becoming excessively lean.

BRIEF DESCRIPTION OF THE DRAWINGS

These and other objects and features of the present invention will become apparent from the following description take in conjunction with the preferred embodiments thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
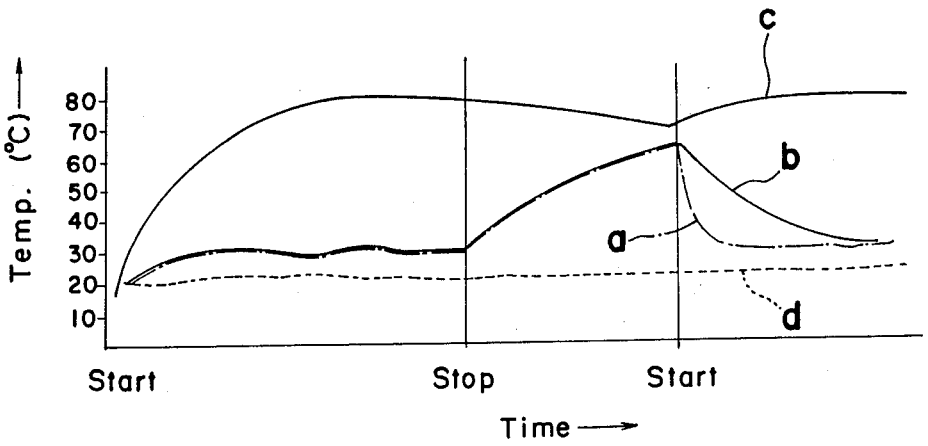
FIG. 1 is a graph showing changes with time of temperature a of intake air in an intake passage of an engine, output b of an air temperature sensor for detecting the temperature a, temperature c of cooling water of the engine and atmospheric temperature d (already referred to)
Figure 2:
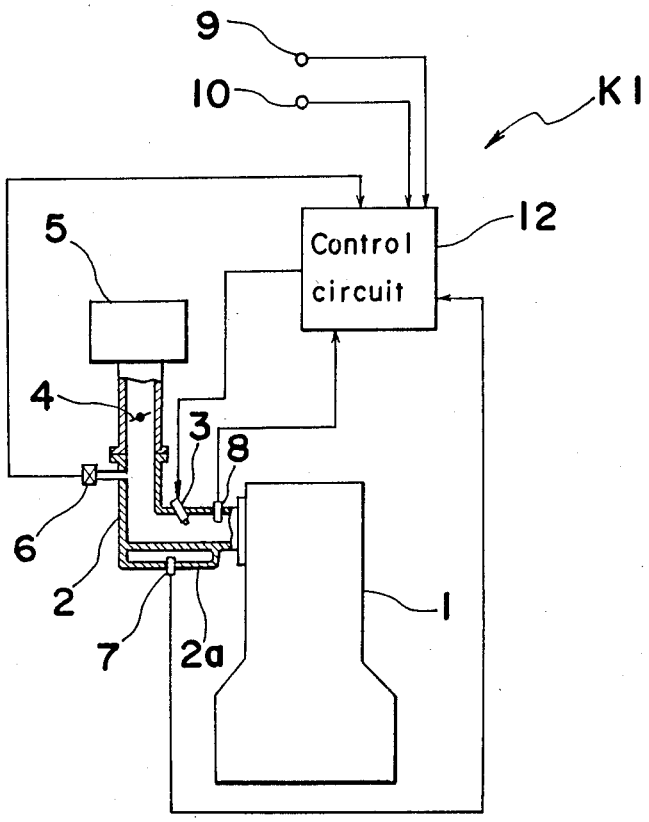
FIG. 2 is a schematic view of a fuel supply arrangement according to a first embodiment of the present invention.

Referring now to the drawings, there is shown in FIG. 2 a fuel supply arrangement K1 for an engine 1, according to a first embodiment of the present invention. It is to be noted that the fuel supply arrangement K1 is applied to a fuel injection device of the engine 1. The engine 1 is connected with an air cleaner 5 through an intake passage 2 formed with a heating portion 2*a* for heating intake air. A fuel injector 3 is provided in the course of the intake passage 2, while a throttle valve 4 is provided in the intake passage 2 and adjacent to the air cleaner 5.

The fuel supply arrangement K1 includes a negative-pressure sensor 6, a water temperature sensor 7 for detecting temperature of cooling water of the engine 1, an air temperature sensor 8 for detecting temperature of the intake air, an ignition switch 9, an engine speed sensor 10 for detecting the number of revolutions of the engine 1, and a control circuit 12 for controlling injected amount of fuel to the engine 1 in response to outputs of the sensors 6 to 8 and 10 and the ignition switch 9. The negative-pressure sensor 6 is a speed density type air flow sensor and is provided in the intake passage 2 and downstream of the throttle valve 4. Meanwhile, the air temperature sensor 8 is provided in the intake passage 2 and adjacent to the engine 1.

Figure 3:
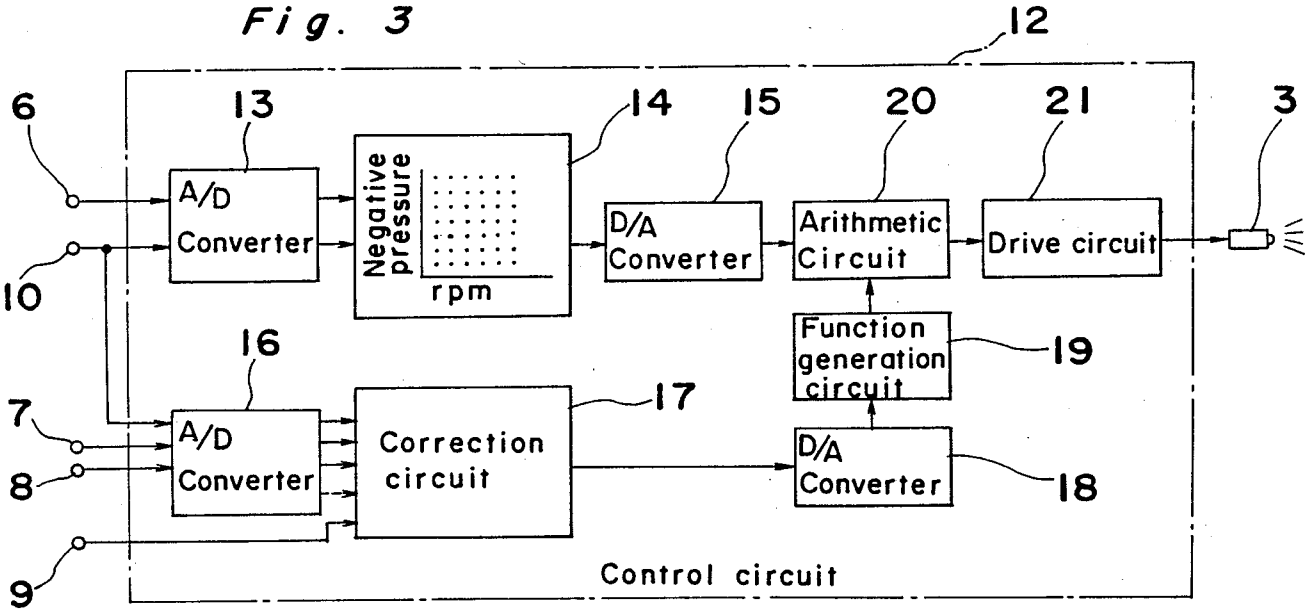
FIG. 3 is a block circuit diagram of a control circuit employed in the fuel supply arrangement of FIG. 2.

Hereinbelow, the control circuit 12 will be described in more detail with reference to FIG. 3. The control circuit 12 includes an analog to digital converter (A/D converter) 13 for effecting analog to digital conversion of the outputs of the engine speed sensor 10 and the negative-pressure sensor 6, a pulse generation circuit 14, and a digital to analog converter (D/A converter) 15 for effecting digital to analog conversion of output of the pulse generation circuit 14. The pulse generation circuit 14 is provided with a map for pulse widths of fundamental fuel injection pulses and having the number of revolutions of the engine 1 and the negative pressure as its parameters so as to generate a fundamental fuel injection pulse width corresponding to the analog to digital converted outputs (delivered from the A/D converter 13) of the sensors 6 and 10.

Figure 4:
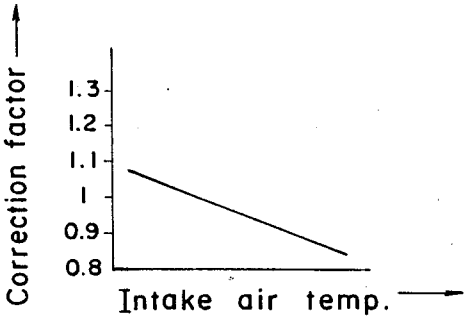
FIG. 4 is a graph showing input/output characteristics of a function generation circuit employed in the control circuit of FIG. 3.

The control circuit 12 further includes another A/D converter 16 for effecting analog to digital conversion of outputs of the water temperature sensor 7, the air temperature sensor 8 and the engine speed sensor 10, a correction circuit 17 for correcting the temperature of the intake air, another D/A converter 18 for effecting digital to analog conversion of output of the correction circuit 17, a function generation circuit 19, an arithmetic circuit 20 and a drive circuit 21 for driving the fuel injector 3 in response to output of the arithmetic circuit 20. The correction circuit 17 is composed of a central processing unit (CPU) which is arranged to usually yield the analog to digital converted output (delivered from the A/D converter 16) of the air temperature sensor 8 as it is in response to the analog to digital converted outputs (delivered from the A/D converter 16) of the sensors 7, 8 and 10 and the output of the ignition switch 9 but which is arranged to yield, for a predetermined time period after starting of the engine 1, an output of a smaller value obtained by correcting the analog to digital converted output (delivered from the A/D converter 16) of the air temperature sensor 8 through subtraction therefrom in the case where the engine 1 is started at a temperature of the cooling water higher than a preset value, i.e., in a hot state of the engine 1. Meanwhile, the function generation circuit 19 outputs a correction factor (FIG. 4) in response to the digital to analog converted output (delivered from the D/A converter 18) of the air temperature sensor 8. As shown in FIG. 4, the correction factor assumes a smaller value as the temperature of the intake air rises. Furthermore, the arithmetic circuit 20 performs an arithmetic operation of multiplying the digital to analog converted fundamental fuel injection pulse width (delivered from the D/A converter 15) by the output of the function generation circuit 19.

In the above described configuration of the fuel supply arrangement K1, the pulse generation circuit 14 acts as an adjusting device for adjusting the supply amount of the fuel to the engine 1, while the function generation circuit 19 and the arithmetic circuit 20 act as a correcting means for correctively controlling said adjusting device 14 on the basis of the output of the air temperature sensor 8 such that the supply amount of the fuel to the engine 1 is decreased as the temperature of the intake air rises. Meanwhile, the water temperature sensor 7 acts as a detecting means for detecting a specific engine operating condition where a temperature of the intake air corresponding to the output of the air temperature sensor is larger than the actual temperature of the intake air. Furthermore, the correction circuit 17 acts as a restricting means for restricting corrective control of said correcting means 19 and 20 in response to a detection output of the specific engine operating condition from said detecting means 7.

Hereinbelow, operations of the fuel supply arrangement K1 will be briefly described with reference to FIG. 3. Initially, when the engine 1 is cranked, the negative-pressure sensor 6 detects the negative pressure of the intake air downstream of the throttle valve 4, the water temperature sensor 7 detects the temperature of the cooling water of the engine 1, the air temperature sensor 8 detects, immediately upstream of the engine 1, the temperature of the intake air heated by the heating portion 2*a*, and the engine speed sensor 10 detects the number of revolutions of the engine 1. Thereafter, the outputs of the negative-pressure sensor 6 and the engine speed sensor 10 are analog to digital converted by the A/D converter 13 and then, are inputted to the pulse generation circuit 14. The fundamental fuel injection pulse width corresponding to the negative pressure of the intake air and the number of revolutions of the engine 1 is generated by the pulse generation circuit 14 and then, is digital to analog converted by the D/A converter 15 so as to be inputted to the arithmetic circuit 20. Meanwhile, the outputs of the water temperature sensor 7, the air temperature sensor 8 and the engine speed sensor 10 are analog to digital converted by the A/D converter 16 and then, are applied to the correction circuit 17. Subsequently, when the ignition signal of the ignition switch 9 is delivered to the correction circuit 17, a decision as to whether or not the engine 1 has been started in the hot state is made on the basis of the temperature of the cooling water of the engine 1 by the correction circuit 17.

In the case where the engine 1 is started in a state other than the hot state, namely the engine 1 is started in the cold state, the analog to digital converted output (delivered from the A/D converter 16) of the air temperature sensor 8 is generated as it is by the correction circuit 17 and then, is digital to analog converted by the D/A converter 18 so as to be inputted to the function generation circuit 19. Thereafter, a correction factor (FIG. 4) corresponding to the output of the air temperature sensor 8 is determined by the function generation circuit 19 so as to be applied to the arithmetic circuit 20. Then, the arithmetic circuit 20 corrects the fundamental fuel injection pulse width by multiplying it by the above described correction factor from the function generation circuit 19 so as to deliver the corrected fundamental fuel injection pulse width to the drive circuit 20. Subsequently, the drive circuit 20 applies fuel injection pulses of the corrected fundamental fuel injection pulse width to the fuel injector 3, whereby the injected amount of the fuel to the engine 1 is correctively controlled in accordance with the output of the air temperature sensor 8 so as to be decreased as the temperature of the intake air rises.

On the other hand, in the case where the engine 1 is started in the hot state, the correction circuit 17 corrects the analog to digital converted output (delivered from the A/D converter 16) of the air temperature sensor 8 to a smaller value for a predetermined time period after starting of the engine 1. Thus, since the function generation circuit 19 outputs a correction factor larger than that in the case of starting of the engine 1 in a state other than the hot state, the injected amount of the fuel to the engine 1 becomes larger in response to even an identical output of the air temperature sensor 8 as compared with that in the case of starting of the engine in a state other than the hot state. Consequently, it will be readily understood that in the case where the engine 1 is started in the hot state, corrective control of the injected amount of the fuel to the engine 1 by the function generation circuit 19 and the arithmetic circuit 20 is restricted for a predetermined time period after starting of the engine 1.

Figure 5:
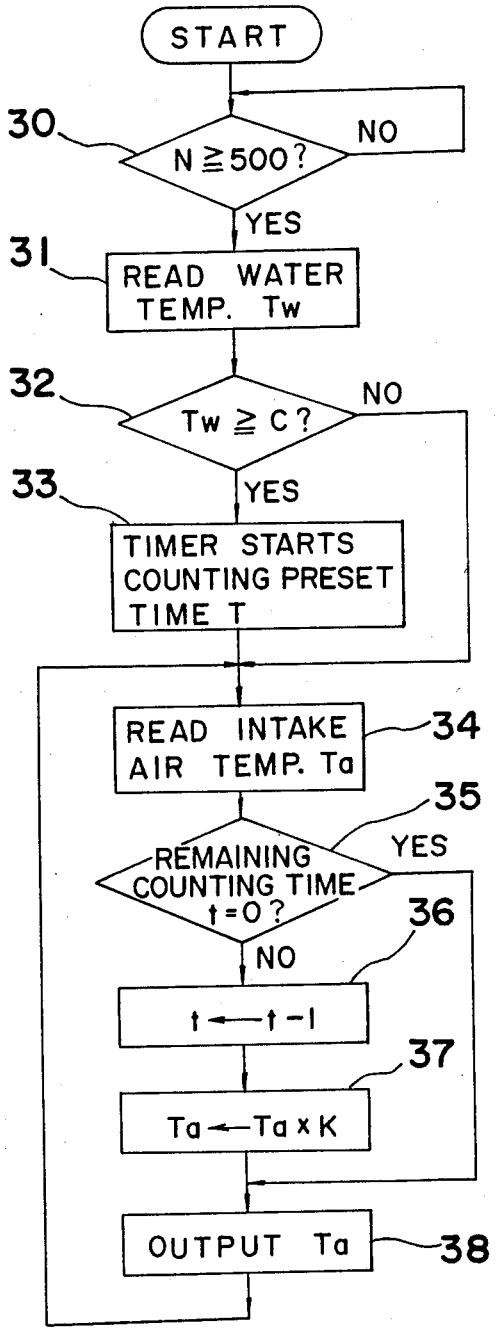
FIG. 5 is a flow chart showing a processing sequence of a correction circuit employed in the control circuit of FIG. 3.

Hereinbelow, operations of the correction circuit 17 will be described in detail with reference to the flow chart of FIG. 5. Initially, when an ignition signal of the ignition switch 9 is applied to the correction circuit 17, the correction circuit 17 reads an analog to digital converted output N of the engine speed sensor 10 and makes a decision at step 30 as to whether or not the output N is not less than a present value of, for example, 500 rpm in order to determine whether or not the engine 1 has been started. The program flow remains at step 30 in a wait state until the engine 1 is started. When the engine 1 has been started, a decision of "YES" is made at step 30 and step 31 follows. At step 31, an analog to digital converted output of the water temperature sensor 7, i.e., a water temperature Tw of the cooling water of the engine 1 is read so as to be stored in a register Rw. Then, a decision is made at step 32 as to whether or not the water temperature Tw is not less than a preset value C so as to determine whether or not the engine 1 is started in the hot state. In the case where the engine 1 is started in the hot state, a decision of "YES" is made at step 32 and step 33 follows. At step 33, a timer starts counting a preset time T. Then, at step 34, an analog to digital converted output of the air temperature sensor 8, i.e., an air temperature Ta of the intake air, is read so as to be stored in a register Ra. Then, if it is found at step 35 that a remaining counting time t of the present time T of the timer is not zero, one is subtracted from the remaining counting time t at step 36. Subsequently, after the air temperature Ta is corrected to a smaller value by multiplying the air temperature Ta by a correction factor K of, for example, 0.8 at step 37, the corrected air temperature Ta is outputted at step 38. Then, the program flow returns to step 34 so as to be repeated between steps 34 and 38. Thereafter, if it is found at step 35 that the remaining counting time t of the timer is zero, the program flow directly proceeds to step 38 at which the air temperature Ta read at latest step 34 is outputted as it is.

Meanwhile, in the case where the engine 1 is started in a state other than the hot state, the correction circuit 17 makes a decision of "NO" at step 32 and then, steps 34, 35 and 38 follow. In this case, the air temperature Ta read at step 34 is also outputted as it is.

As is clear from the foregoing description, in accordance with the present invention, in the case where the engine has been started in the hot state, the output of the air temperature sensor is corrected to a smaller value such that injected amount of the fuel to the engine is correctively controlled to a larger value on the basis of the corrected output of the air temperature sensor, so that such a phenomenon does not take place that the injected amount of the fuel to the engine becomes insufficient due to excessive corrective control of the injected amount of the fuel to the engine. As a result, it becomes possible to prevent the air-fuel mixture from becoming excessively lean, thereby eliminating drop of output of the engine or stop of the engine.

Figure 6:
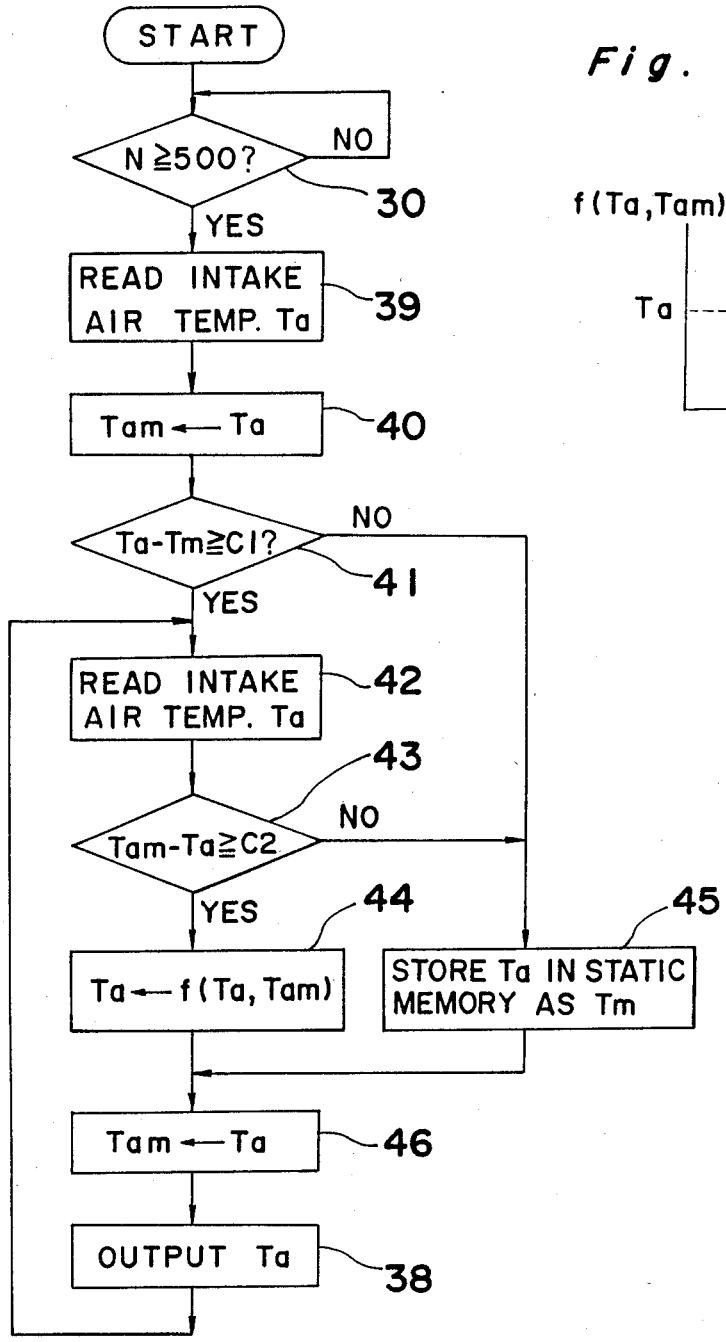
FIG. 6 is a flow chart similar to FIG. 5, particularly showing a modification thereof.

Meanwhile, it is so arranged in the first embodiment of the present invention that the corrective control of the injected amount of the fuel to the engine on the basis of the temperature of the intake air is restricted through detection of the high temperature of the cooling water of the engine at the time of starting of the engine, i.e., starting of the engine in the hot state. However, since the air-fuel mixture becomes excessively lean due to, for example, such a cause that sudden increase of amount of the intake air changes the temperature of the intake air sharply, it can be also so arranged as shown in the flow chart of FIG. 6 showing a modification of the first embodiment of the present invention that corrective control of the injected amount of the fuel to the engine on the basis of the temperature of the intake air is restricted when a difference between the temperature of the intake air at the time of stop of the engine and that at the time of start of the engine is large. Hereinbelow, operations of the modified correction circuit 17 will be described with reference to the flow chart of FIG. 6. Initially, when an ignition signal of the ignition switch 9 is applied to the correction circuit 17, a decision is made in the correction circuit 17 at step 30 as to whether or not the engine 1 has been started. In the case of "YES" at step 30, step 39 follows at which the output Ta of the air temperature sensor 8 is read so as to be stored in the register Ra. Then, at step 40, the output Ta stored in the register Ra is stored, as a value Tam, in a register Ram. Subsequently, at step 41, a decision is made as to whether or not a difference between the output Ta of the air temperature sensor 8 at the time of start of the engine, which is stored in the register Ra, and an output Tm of the air temperature sensor 8 at the time of stop of the engine, which is stored in a static memory Rm to be described later, i.e., a value of (Ta−Tm) is not less than a preset value C1.

Figure 7:
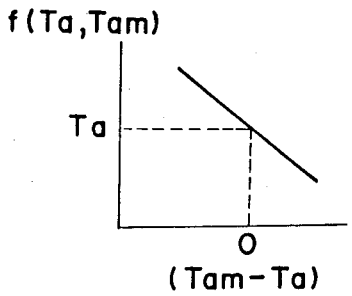
FIG. 7 is a graph explanatory of operation of the correction circuit of the control circuit of FIG. 3.

In the case of "YES" at step 41, step 42 follows. At step 42, the output Ta of the air temperature sensor 8 is again read so as to be stored in the register Ra. Thereafter, at step 43, a decision is made as to whether or not a difference between the output Ta stored in the register Ra and the value Tam stored in the register Ram, i.e., a value of (Tam−Ta) is not less than a preset value C2. In the case of "YES" at step 43, the air temperature sensor 8 changes in outputs so as to be subjected to time lag of detection and thus, step 44 follows. At step 44, a proper output value Ta of the air temperature sensor 8 is determined, as a function f(Ta, Tam), from the contents Ta and Tam stored in the registers Ra and Ram, respectively. Then, at step 46, the content Tam of the register Ram is reset by the content Ta of the register Ra. Subsequently, the output value Ta of the air temperature sensor 8, which has been determined at step 44, is outputted at step 38. Meanwhile, the output value Ta of step 44 is determined by, for example, using characteristics of the function f(Ta, Tam) relative to the difference between the contents Ta and Tam stored in the registers Ra and Ram, respectively, i.e., the value of (Tam−Ta) as shown in FIG. 7. Namely, the output of the air temperature sensor 8 can be corrected in accordance with a change rate of the temperature of the intake air.

Meanwhile, in the case of "NO" at step 41 or in the case of "NO" at step 43, the air temperature sensor 8 is not subjected to time lag of detection and thus, step 45 follows. At step 45, the output of the air temperature sensor 8, which has been read at step 39 or 42, is stored, as the value Tm, in the static memory Rm and steps 46 and 38 follow. Thus, at step 38, the output Ta of the air temperature sensor 8, which has been stored in the register Ra, is outputted as it is.

In the above described first embodiment and its modification of the present invention, starting of the engine in the hot state having the high-temperature cooling water of the engine and a large difference between the temperature of the intake air at the time of start of the engine and that at the time of stop of the engine are, respectively, detected as specific engine operating conditions where corrective control of the injected amount of the fuel to the engine on the basis of the output of the air temperature sensor is restricted. However, it can be also so arranged that engine operating conditions where the output of the air temperature sensor assumes a value higher than the actual temperature of the intake air are detected as the specific engine operating conditions at the time of the mere start of the engine or acceleration of the engine. Furthermore, if it becomes possible to prevent the air-fuel mixture from becoming excessively lean, the corrective control of the injected amount of the fuel to the engine on the basis of the output of the air temperature sensor can be restricted by employing any other method.

Moreover, although the first embodiment and its modification of the present invention have been described with respect to the fuel injection device of the engine, it is needless to say that the present invention is also applicable to the carburetor of the engine. In addition, the air flow sensor is not restricted, in type, to speed density type but can be of Karman vortex type or vane type.

As is clear from the foregoing description, in the fuel supply arrangement for the engine according to the first embodiment of the present invention, in which the air temperature sensor is provided in the intake passage of the engine such that the supply amount of the fuel to the engine is correctively controlled on the basis of the output of the air temperature sensor, the specific engine operating condition where the output of the air temperature sensor assumes the value higher than the actual temperature of the intake air is detected such that the corrective control of the supply amount of the fuel to the engine on the basis of the output of the air temperature sensor is restricted in the specific engine operating condition. Accordingly, in accordance with the present invention, such a phenomenon does not take place that the corrective control of the supply amount of the fuel to the engine is excessively effected with the result that the amount of the fuel in the engine becomes insufficient. Thus, in accordance with the present invention, it becomes possible to prevent the air-fuel mixture from becoming excessively lean, thereby eliminating drop of the output of the engine or stop of the engine.

Figure 8:
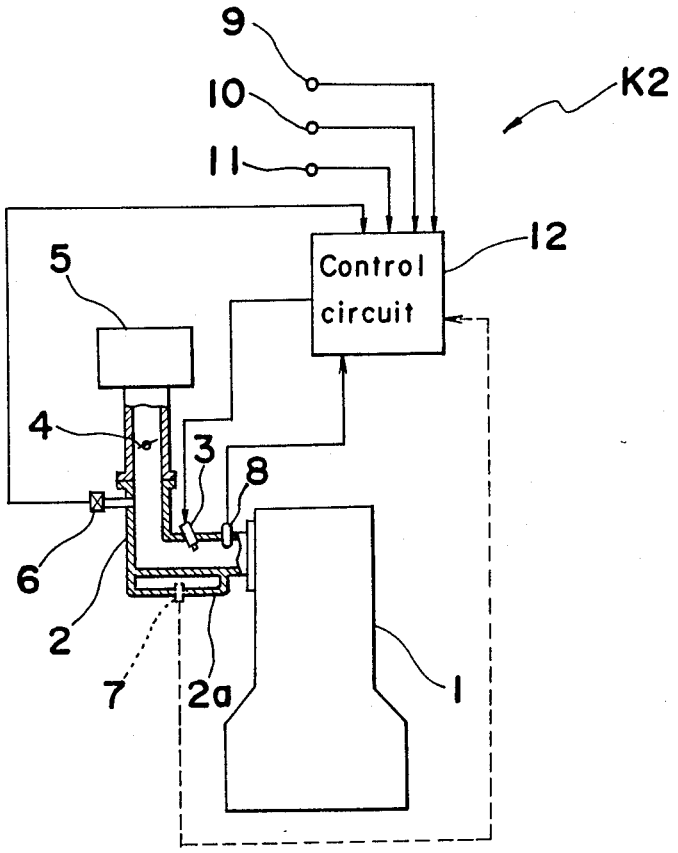
FIG. 8 is a view similar to FIG. 2, particularly showing a fuel supply arrangement according to a second embodiment of the present invention.

Referring to FIG. 8, there is shown a fuel supply arrangement K2 for the engine 1, according to a second embodiment of the present invention. It is to be noted that the fuel supply arrangement K2 is applied to a fuel injection device of the engine 1. In the same manner as the first embodiment of the present invention, the engine 1 is connected with the air cleaner 5 through the intake passage 2 formed with the heating portion 2*a* for heating intake air. The fuel injector 3 is provided in the course of the intake passage 2, while the throttle valve 4 is provided in the intake passage 2 and adjacent to the air cleaner 5.

Further, in the same manner as the fuel supply arrangement K1, the fuel supply arrangement K2 includes the negative-pressure sensor 6, air temperature sensor 8, ignition switch 9, engine speed sensor 10 and control circuit 12. However, the fuel supply arrangement K2 is not provided with the water temperature sensor 7 of the fuel supply arrangement K1 but includes an atmospheric temperature sensor 11 for detecting atmospheric temperature. It should be noted that in the fuel supply arrangement K2, a specific engine operating condition where a change rate of the output of the air temperature sensor 8 is not less than a preset value is detected such that corrective control of supply amount of the fuel to the engine 1 on the basis of the output of the air temperature sensor 8 is restricted in the specific engine operating condition, whereby the air-fuel mixture is prevented from becoming excessively lean.

Figure 9:
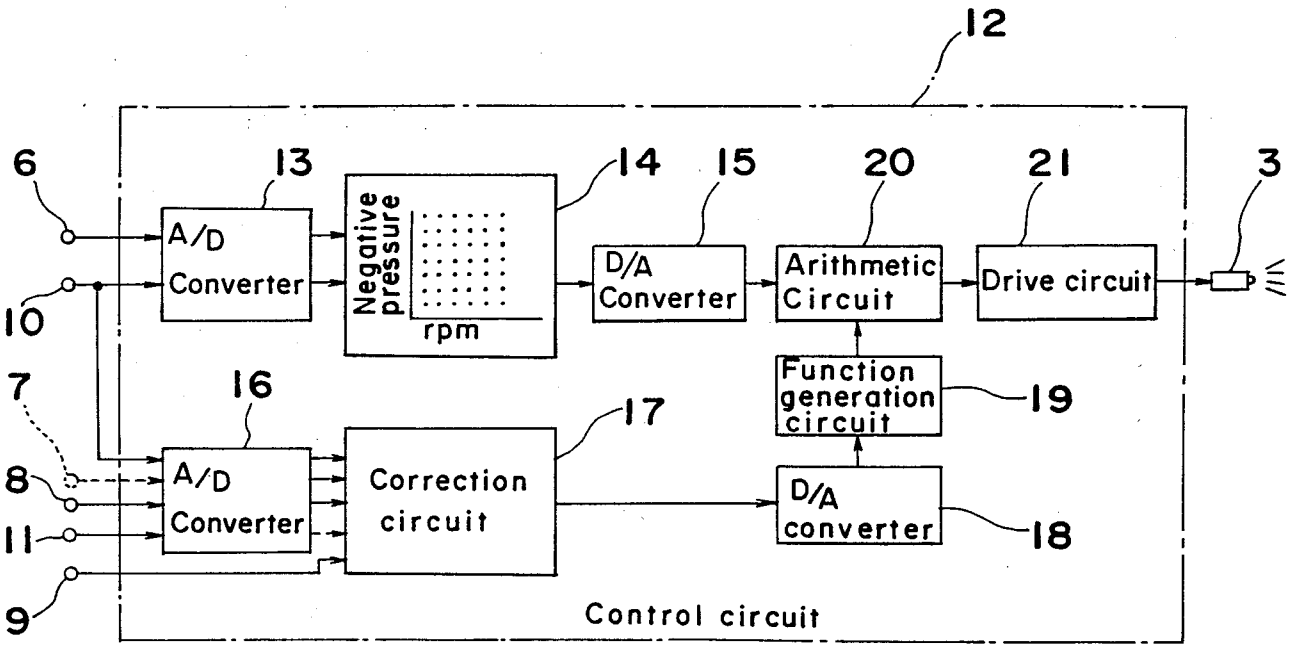
FIG. 9 is a diagram similar to FIG. 3, particularly showing a control circuit employed in the fuel supply arrangement of FIG. 8.

Referring to FIG. 9, there is shown the control circuit 12. In the same manner as the control circuit 12 of the fuel supply arrangement K1, the control circuit 12 of the fuel supply arrangement K2 includes the A/D converter 13, pulse generation circuit 14, D/A converter 15, A/D converter 16 for effecting analog to digital conversion of outputs of the air temperature sensor 8, engine speed sensor 10 and atmospheric temperature sensor 11, correction circuit 17 for correcting temperature of the intake air, D/A converter 18, function generation circuit 19, arithmetic circuit 20 and drive circuit 21. The correction circuit 17 is composed of a central processing unit (CPU) which is arranged to yield the analog to digital converted output of the air temperature sensor 8 as it is in response to the analog to digital converted outputs of the sensors 8, 10 and 11 and the output of the ignition switch 9 when a change rate of difference between temperature of the intake air and atmospheric temperature is less than a preset value but which is arranged to yield, in place of the analog to digital converted output delivered at that time from the air temperature sensor 8, the analog to digital converted output delivered at the time of stop of the engine 1 from the air temperature sensor 8 when the change rate is not less than the preset value.

In the above described configuration of the fuel supply arrangement K2, the pulse generation circuit 14 acts as an adjusting device for adjusting the supply amount of the fuel to the engine 1, while the function generation circuit 19 and the arithmetic circuit 20 act as a correcting means for correctively controlling said adjusting device 14 on the basis of the output of the air temperature sensor 8 such that the supply amount of the fuel to the engine 1 is decreased as the temperature of the intake air rises in the same manner as the fuel supply arrangement K1. Furthermore, the correction circuit 17 acts not only as a detecting means for detecting the specific engine operating condition where the change rate of the air temperature sensor 8 is not less than the preset value but as a restricting means for restricting corrective control of said correcting means 19 and 20 in response to a detection output of the specific engine operating condition from said detecting means 17.

Hereinbelow, operations of the fuel supply arrangement K2 will be briefly described with reference to FIG. 9. Initially, when the engine 1 is cranked, the negative-pressure sensor 6 detects the negative pressure of the intake air downstream of the throttle valve 4, the air temperature sensor 8 detects, immediately upstream of the engine 1, the temperature of the intake air heated by the heating portion 2*a*, the engine speed sensor 10 detects the number of revolutions of the engine 1 and the atmospheric temperature sensor 11 detects the atmospheric temperature. Subsequently, the outputs of the negative-pressure sensor 6 and the engine speed sensor 10 are analog to digital converted by the A/D converter 13 and then, are inputted to the pulse generation circuit 14. Meanwhile, the outputs of the air temperature sensor 8, the engine speed sensor 10 and the atmospheric temperature sensor 11 are analog to digital converted by the A/D converter 16 and then, are applied to the correction circuit 17. Thereafter, when the ignition signal of the ignition switch 9 is delivered to the correction circuit 17, the correction circuit 17 makes a decision as to whether or not the change rate of difference between outputs of the air temperature sensor 8 and the atmospheric temperature sensor 11 is larger than the preset value.

In the case where the change rate is less than the preset value, the analog to digital converted output of the air temperature sensor 8 is generated as it is by the correction circuit 17 and then, is digital to analog converted by the D/A converter 18 so as to be inputted to the function generation circuit 19. Since other operations of the control circuit 12 of the fuel supply arrangement K2 are the same as those of the control circuit 12 of the fuel supply arrangement K1, detailed description thereof is abbreviated for the sake of brevity.

On the other hand, in the case where the change rate of the difference between the outputs of the air temperature sensor 8 and the atmospheric temperature sensor 11 is larger than the preset value, the correction circuit 17 yields, in place of the output delivered at that time from the air temperature sensor 8, the analog to digital converted output having a fixed value delivered at the time of stop of the engine 1 from the air temperature sensor 8. Thus, since the function generation circuit 19 outputs a correction factor corresponding to the output delivered at the time of stop of the engine 1 from the air temperature sensor 8, the injected amount of the fuel to the engine 1 is correctively controlled on the basis of the temperature of the intake air measured at the time of stop of the engine 1. Accordingly, it will be readily understood that in the case where the change rate of the difference between the outputs of the air temperature sensor 8 and the atmospheric temperature sensor 11 is large, corrective control of the injected amount of the fuel to the engine 1 by the function generation circuit 19 and the arithmetic circuit 20 is restricted.

Figure 10:
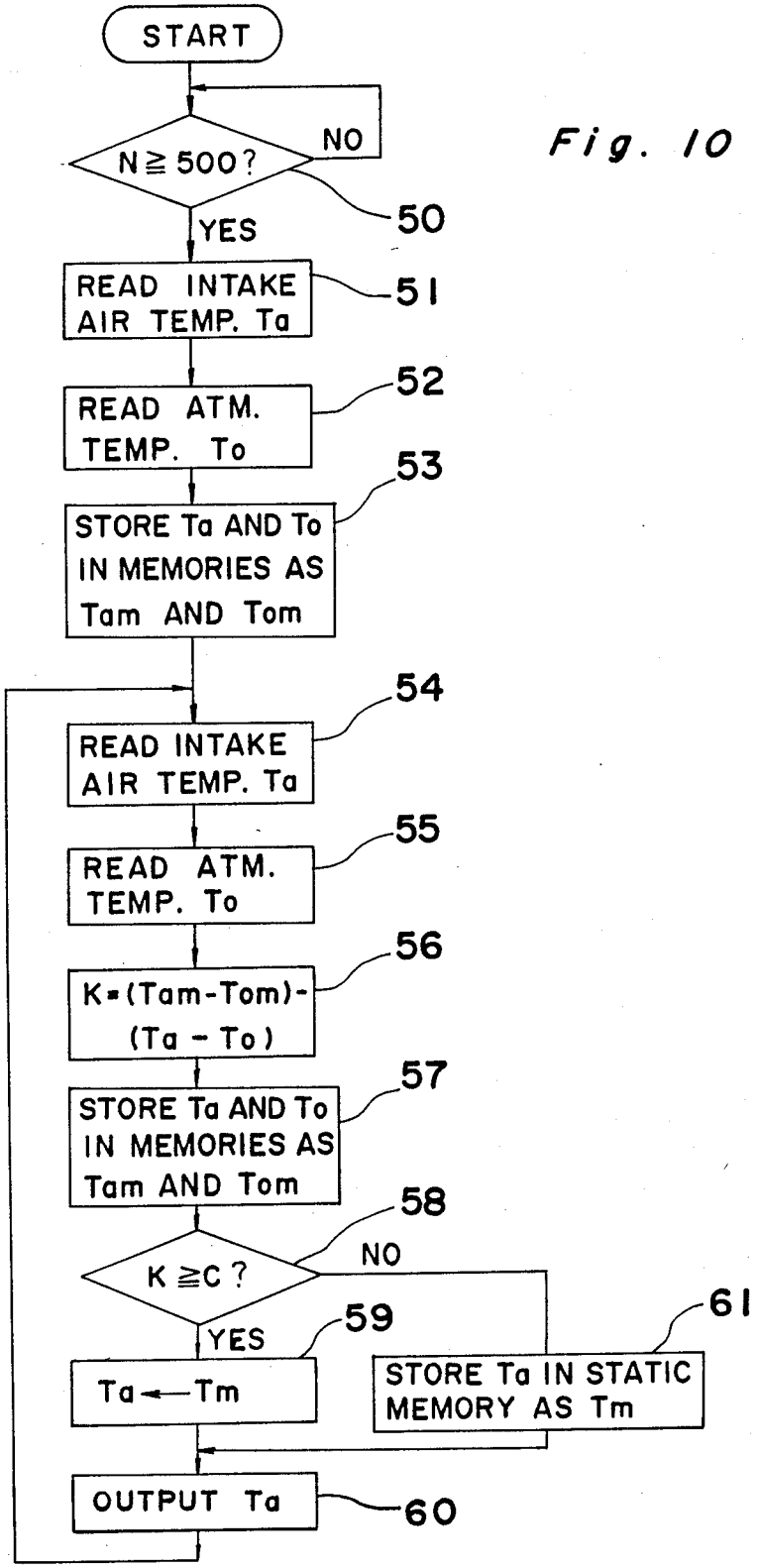
FIG. 10 is a flow chart showing a processing sequence of a correction circuit employed in the control circuit of FIG. 9.

Hereinbelow, operations of the correction circuit 17 will be described with reference to the flow chart of FIG. 10. Initially, when an ignition signal of the ignition switch 9 is applied to the correction circuit 17, the correction circuit 17 reads an analog to digital converted output N of the engine speed sensor 10 and makes a decision at step 50 as to whether or not the output N is not less than a preset value of, for example, 500 rpm in order to determine whether or not the engine 1 has been started. The program flow remains at step 50 in a wait state until the engine 1 is started. When the engine 1 has been started, a decision of "YES" is made at step 50. Subsequently, at step 51, an analog to digital converted output Ta of the air temperature sensor 8 is read so as to be stored in a register Ra and then, at step 52, an analog to digital converted output To of the atmospheric temperature sensor 11 is read so as to be stored in a register Ro. Then, at step 53, the contents Ta and To stored in the registers Ra and Ro, respectively are stored, as values Tam and Tom, in memories Ma and Mo, respectively. Thereafter, at steps 54 and 55, the analog to digital converted output Ta of the air temperature sensor 8 and the analog to digital converted output To of the atmospheric temperature sensor 11 are again read so as to be stored in the registers Ra and Ro, respectively. A change rate K of the difference between the outputs of the air temperature sensor 8 and the atmospheric temperature sensor 11 is expressed by the equation:

$$K=(Tam-Tom)-(Ta-To)$$

At step 56, the change rate K is obtained from the contents Ta and To stored in the registers Ra and Ro and the contents Tam and Tom stored in the memories Ma and Mo, respectively. Further, at step 57, the contents Tam and Tom stored in the memories Ma and Mo, respectively are, respectively, reset by the contents Ta and To stored in the registers Ra and Ro, respectively. Then, at step 58, a decision is made as to whether or not the change rate K is not less than a preset value C.

In the case of "YES" at step 58, step 59 follows. At step 59, the content Ta stored in the register Ra is reset by an output Tm delivered at the time of stop of the engine 1 from the air temperature sensor 8, which output Tm is stored in a static memory Rm to be described later. Then, the content Ta of the register Ra is outputted at step 60. Thereafter, the program flow returns to step 54 so as to be repeated between steps 54 and 60.

Meanwhile, in the case of "NO" at step 58, step 61 follows. At step 61, the output Ta of the air temperature sensor 8, which has been read in the register Ra at step 54, is stored, as the value Tm, in the static memory Rm. Then, the output Ta is outputted at step 60.

As is clear from the foregoing description, in the fuel supply arrangement K2, when the change rate K of the difference between the outputs of the air temperature sensor 8 and the atmospheric temperature sensor 11 is large, the injected amount of the fuel to the engine 1 is correctively controlled on the basis of, in place of the output delivered at that time from the air temperature sensor 8, the output having a fixed value delivered at the time of stop of the engine 1 from the air temperature sensor 8, so that such a phenomenon does not take place that the injected amount of the fuel to the engine 1 becomes insufficient due to excessive corrective control of the injected amount of the fuel to the engine 1. As a result, it becomes possible to prevent the air-fuel mixture from becoming excessively lean, thereby eliminating drop of output of the engine 1 or stop of the engine 1.

Figure 11:
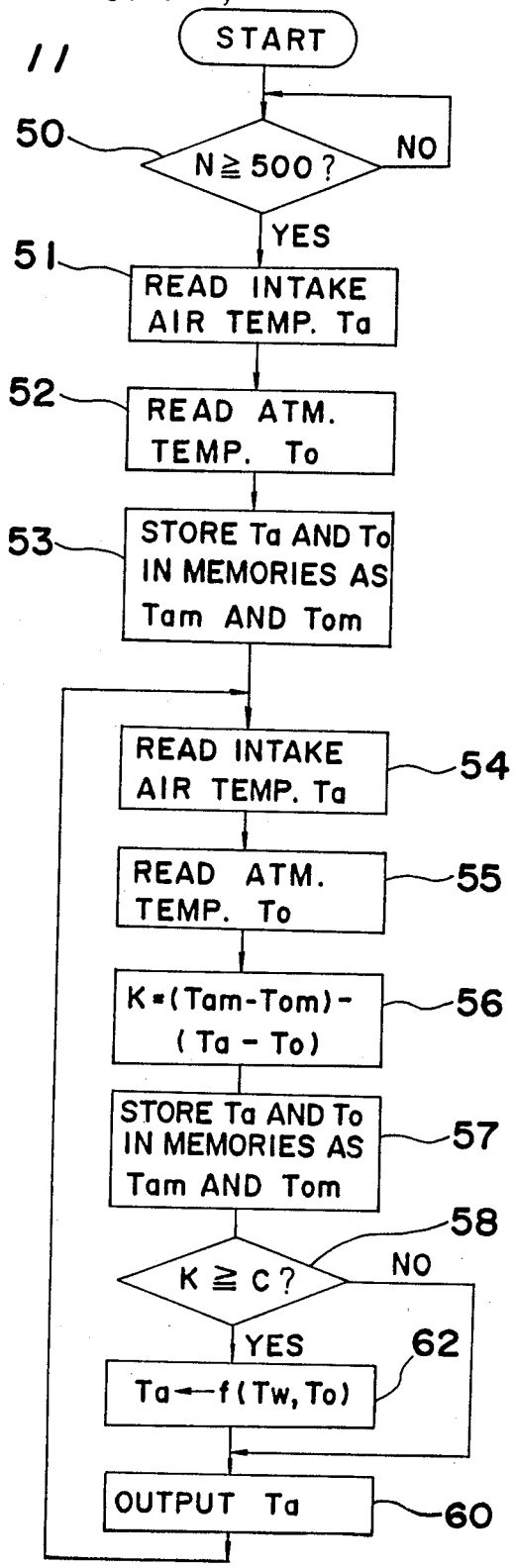
FIG. 11 is a flow chart similar to FIG. 10, particularly showing a modification thereof.
Figure 12:
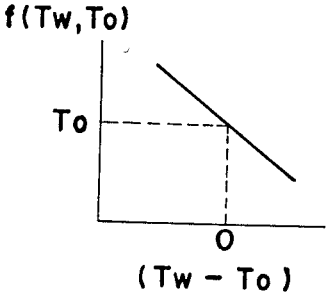
FIG. 12 is a graph explanatory of operation of the correction circuit of the control circuit of FIG. 9.

Meanwhile, it is so arranged in the second embodiment of the present invention that in the specific engine operating condition where the change rate of the difference between the outputs of the air temperature sensor 8 and the atmospheric temperature sensor 11 is large, the injected amount or the fuel to the engine 1 is correctively controlled on the basis of the output delivered at the time of stop of the engine 1 from the air temperature sensor 8. However, it can be also so arranged that the injected amount of the fuel to the engine 1 is correctively controlled on the basis of an atmospheric temperature To corrected by a water temperature Tw of the cooling water of the engine 1 as shown in the flow chart of FIG. 11 illustrating a modification of the second embodiment of the present invention. In FIG. 11, at step 62, a proper output value Ta of the air temperature sensor 8 is determined by, for example, using characteristics of FIG. 12 relative to the difference between the output To of the atmospheric temperature sensor 11 and the output Tw of the water temperature sensor 7 shown by the broken lines in FIGS. 8 and 9, namely the atmospheric temperature To corrected by the water temperature Tw is stored, as the output Ta of the air temperature sensor 8, in the register Ra. Since other steps of FIG. 11 are similar to those of FIG. 10, detailed description thereof is abbreviated for the sake of brevity.

In the above described second embodiment and its modification of the present invention, it is so arranged that in the specific engine operating condition, the injected amount of the fuel to the engine 1 is correctively controlled on the basis of, in place of the output delivered at that time from the air temperature sensor 8, the output delivered at the time of stop of the engine 1 from the air temperature sensor 8 or the atmospheric temperature To corrected by the water temperature Tw. However, it can be also so arranged that the corrective control of the injected amount of the fuel to the engine 1 on the basis of the output of the air temperature sensor 8 in the specific engine operating condition is performed by using output of the air temperature sensor 8 in another engine operating condition, atmospheric temperature or a fixed value. Furthermore, it can be also so arranged that the corrective control is not performed at all in the specific engine operating condition. Moreover, if the corrective control of the injected amount of the fuel to the engine 1 on the basis of the output of the air temperature sensor 8 is restricted in the specific engine operating condition, it can be also so arranged that without cancelling the corrective control of the injected amount of the fuel to the engine 1 on the basis of the output of the air temperature sensor 8, the injected amount of the fuel to the engine 1 is correctively controlled on the basis of a corrected output of the air temperature sensor 8.

Meanwhile, in the second embodiment and its modification of the present invention, the engine operating condition where the change rate of the difference between the outputs of the air temperature sensor 8 and the atmospheric temperature sensor 11 is large is detected as the specific engine operating condition where the corrective control of the injected amount of the fuel to the engine 1 on the basis of the output of the air temperature sensor 8 should be restricted. However, an engine operating condition where a change rate of the output of the air temperature sensor 8 is large can be detected as the specific engine operating condition.

As is clear from the foregoing description, in the fuel supply arrangement for the engine according to the second embodiment of the present invention, in which the air temperature sensor is provided in the intake passage of the engine such that the supply amount of the fuel to the engine is correctively controlled on the basis of the output of the air temperature sensor, the specific engine operating condition where the change rate of the output of the air temperature sensor is large is detected such that the corrective control of the supply amount of the fuel to the engine on the basis of the output of the air temperature sensor is restricted in the specific engine operating condition. Accordingly, in accordance with the present invention, since such a phenomenon does not take place that the amount of the fuel in the engine becomes insufficient due to excessive corrective control of the supply amount of the fuel to the engine. Thus, in accordance with the present invention, it becomes possible to prevent the air-fuel mixture from becoming excessively lean, thereby eliminating drop of the output of the engine or stop of the engine.

Figure 13:
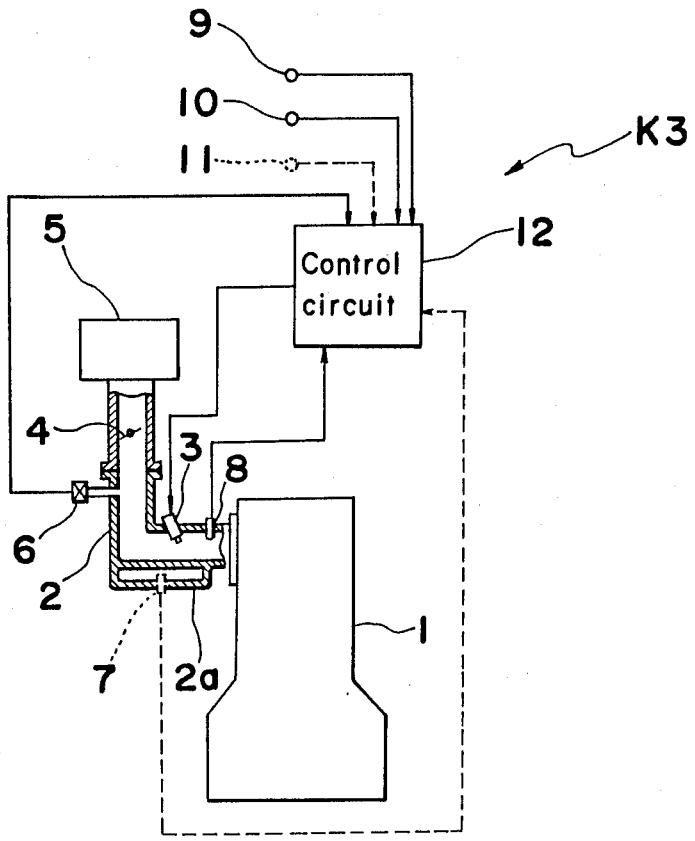
FIG. 13 is a view similar to FIG. 2, particularly showing a fuel supply arrangement according to a third embodiment of the present invention.

Referring to FIG. 13, there is shown a fuel supply arrangement K3 for the engine 1, acccrding to a third embodiment of the present invention. It is to be noted that the fuel supply arrangement K3 is applied to a fuel injection device of the engine 1. In the same manner as the first embodiment of the present invention, the engine 1 is connected with the air cleaner 5 through the intake passage 2 formed with the heating portion 2*a* for heating intake air. The fuel injector 3 is provided in the course of the intake passage 2, while the throttle valve 4 is provided in the intake passage 2 and adjacent to the air cleaner 5.

Further, in the same manner as the fuel supply arrangement K1, the fuel supply arrangement K3 includes the negative-pressure sensor 6, air temperature sensor 8, ignition switch 9, engine speed sensor 10 and control circuit 12. However, the fuel supply arrangement K3 is not provided with the water temperature sensor 7 of the fuel supply arrangement K1. It should be noted that in the fuel supply arrangement K3, a specific engine operating condition where the air temperature sensor 8 assumes a value higher than the actual temperature of the intake air is detected such that corrective control of supply amount ot the fuel to the engine 1 on the basis of the output of the air temperature sensor is cancelled in the specific engine operating condition, whereby the air-fuel mixture is prevented from becoming excessively lean.

Figure 14:
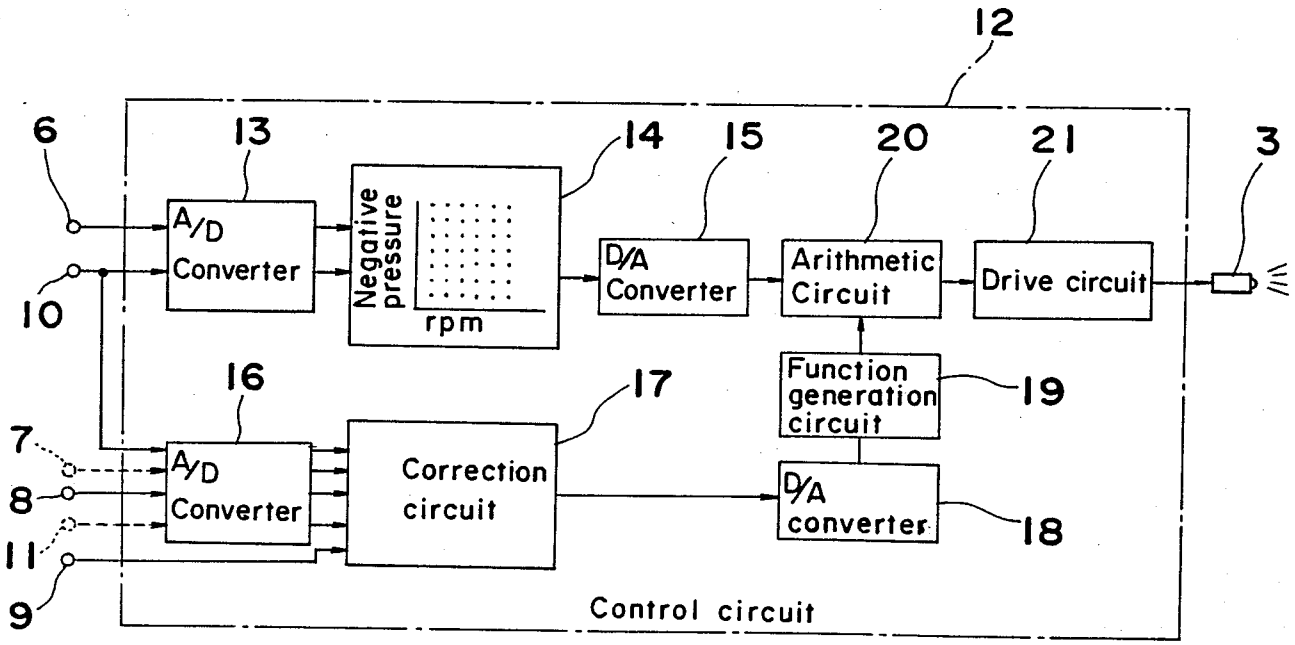
FIG. 14 is a diagram similar to FIG. 3, particularly showing a control circuit employed in the fuel supply arrangement of FIG. 13.

Referring to FIG. 14, there is shown the control circuit 12. In the same manner as the control circuit 12 of the fuel supply arrangement K1, the control circuit 12 of the fuel supply arrangement K3 includes the A/D converter 13, pulse generation circuit 14, D/A converter 15, A/D converter 16 for effecting analog to digital conversion of outputs of the air temperature sensor 8 and engine speed sensor 10, correction circuit 17 for correcting temperature of the intake air, D/A converter 18, function generation circuit 19, arithmetic circuit 20 and drive circuit 21. The correction circuit 17 is composed of a central processing unit (CPU) which is arranged to usually yield the analog to digital converted output of the air temperature sensor 8 as it is in response to the analog to digital outputs of the sensors 8 and 10 and the output of the ignition switch 9 but which is arranged to yield, for a predetermined time period after starting of the engine 1, the analog to digital converted output having a fixed value delivered at the time of stop of the engine 1 from the air temperature sensor 8, in the case where the temperature of the intake air at the time of starting of the engine 1 is higher than that at the time of stop of the engine 1.

In the above described configuration of the fuel supply arrangement K3, the pulse generation circuit 14 acts as an adjusting device for adjusting the supply amount of the fuel to the engine 1, while the function generation circuit 19 and the arithmetic circuit 20 act as a correcting means for correctively controlling said adjusting device 14 on the basis of the output of the air temperature sensor 8 such that the supply amount of the fuel to the engine 1 is decreased as the temperature of the intake air rises in the same manner as the fuel supply arrangement K1. Furthermore, the correction circuit 17 acts not only as a detecting means for detecting the specific engine operating condition where the output of the air temperature sensor 8 assumes a value higher than the actual temperature of the intake air but as a cancelling means for cancelling the above described corrective control in response to a detection output of the specific engine operating condition from said detecting means 17.

Hereinbelow, operations of the fuel supply arrangement K3 will be briefly described with reference to FIG. 14. Initially, when the engine 1 is cranked, the negative-pressure sensor 6 detects the negative pressure of the intake air downstream of the throttle valve 4, the air temperature sensor 8 detects, immediately upstream of the engine 1, the temperature of the intake air heated by the heating portion 2*a* and the engine speed sensor 10 detects the number of revolutions of the engine 1. Subsequently, the outputs of the negative pressure sensor 6 and the engine speed sensor 10 are analog to digital converted by the A/D converter 13 and then, are inputted to the pulse generation circuit 14. Meanwhile, the outputs of the air temperature sensor 8 and the engine speed sensor 10 are analog to digital converted by the A/D converter 16 and then, are applied to the correction circuit 17. Thereafter, when the ignition signal of the ignition switch 9 is applied to the correction circuit 17, the correction circuit 17 makes a decision as to whether or not the temperature of the intake air at the time of starting of the engine 1 is higher than that at the time of stop of the engine 1.

In the case where the temperature of the intake air at the time of starting of the engine is not higher than that at the time of stop of the engine 1, the analog to digital converted output of the air temperature sensor 8 is generated as it is by the correction circuit 17 and then, is digital to analog converted by the D/A converter 18 so as to be inputted to the function generation circuit 19.

On the other hand, in the case where the temperature of the intake air at the time of starting of the engine 1 is higher than that at the time of stop of the engine 1, the correction circuit 17 yields, for a predetermined time period after starting of the engine 1, the analog to digital converted output having a fixed value delivered at the time of stop of the engine 1 from the air temperature sensor 8, in place of the analog to digital converted output delivered at that time from the air temperature sensor 8. Thus, since the function generation circuit 19 outputs a correction factor corresponding to the output delivered at the time of stop of the engine 1 from the air temperature sensor 8, the injected amount of the fuel to the engine 1 is correctively controlled on the basis of the temperature of the intake air measured at the time of stop of the engine 1. Accordingly, in the case where the temperature of the intake air measured at the time of starting of the engine 1 is high, the corrective control of the injected amount of the fuel to the engine 1 on the basis of the output delivered at that time from the air temperature sensor 8 is cancelled for a predetermined time period after starting of the engine 1.

Figure 15:
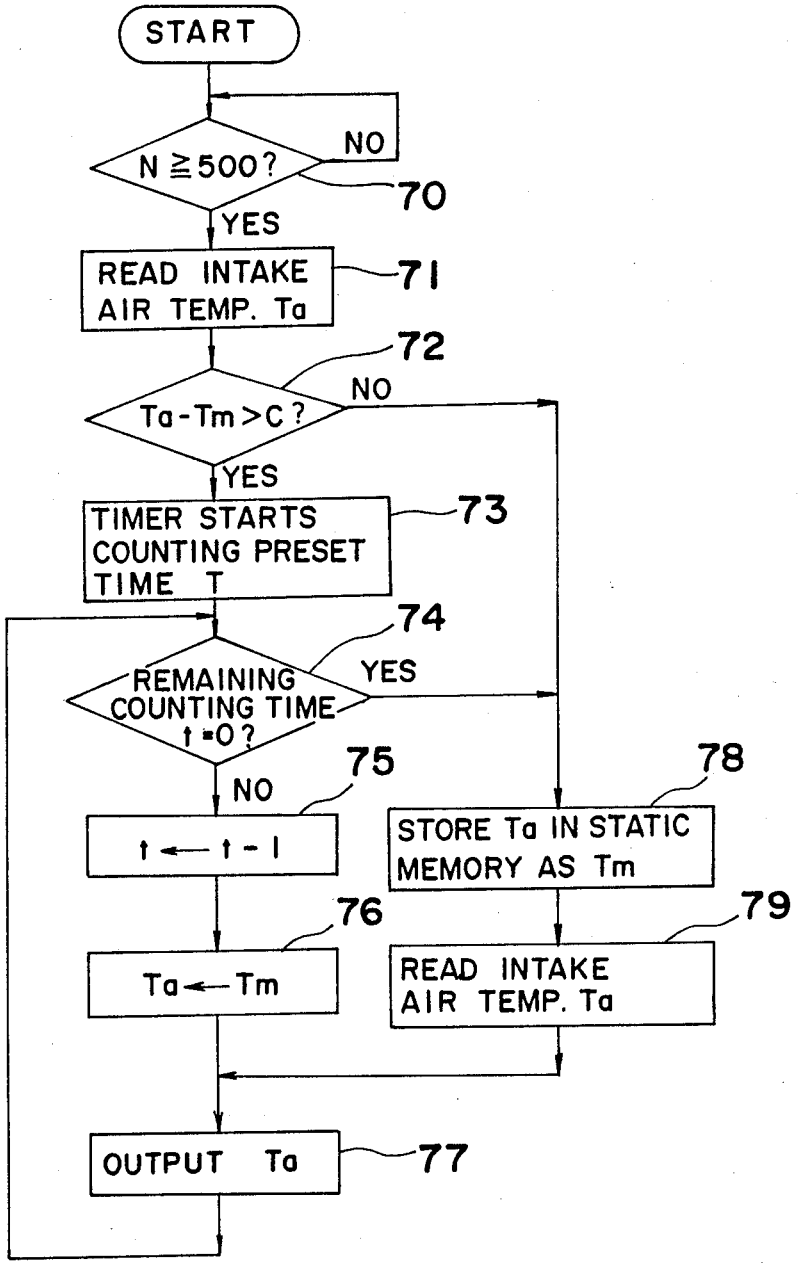
FIG. 15 is a flow chart showing a processing sequence of a correction circuit employed in the control circuit of FIG. 14.

Hereinbelow, operations of the correction circuit 17 will be described with reference to the flow chart of FIG. 15. Initially, when an ignition signal of the ignition switch 9 is applied to the correction circuit 17, the correction circuit 17 reads an analog to digital converted output N of the engine speed sensor 10 and makes a decision at step 70 as to whether or not the output N is not less than a preset value of, for example, 500 rpm, in order to determined whether or not the engine 1 has been started. The program flow remains at step 70 in a wait state until the engine 1 is started. When the engine 1 has been started, a decision of "YES" is made at step 70. Subsequently, at step 71, an analog to digital converted output Ta of the air temperature sensor 8 is read so as to be stored in a register Ra. Then, at step 72, a difference between the content Ta stored in the register Ra and a temperature Tm of the intake air measured at the time of stop of the engine 1 and stored in a static memory Rm to be described later, i.e., a value of (Ta−Tm) is obtained so as to decide whether or not the value of (Ta−Tm) is larger than a preset value C.

In the case of "YES" at step 72, a timer starts counting a preset time T at step 73. Then, if it is found at step 74 that a remaining counting time t of the present time T of the timer is not zero, one is subtracted from the remaining counting time t at step 75. Subsequently, at step 76, the content Ta stored in the register Ra is reset by the temperature Tm of the intake air measured at the time of stop of the engine 1 and stored in the static memory Rm. Then, the content Ta of the register Ra is outputted at step 77. Thereafter, the program flow returns to step 74 so as to be repeated between steps 74 and 77. Thereafter, if it is found at step 74 that the remaining counting time t of the timer is zero, the program flow directly proceeds to step 78. At step 78, the content Tm of the static memory Rm is reset by the content Ta of the register Ra and step 79 follows. At step 79, an analog to digital converted output Ta of the air temperature sensor 8 is again read so as to be stored in the register Ra and step 77 follows.

In the case of "NO" at step 72, the program flow proceeds to steps 78, 79 and 77. In this case also, the content Tm of the static memory Rm is reset by the content Ta of the register Ra and the temperature Ta of the intake air read newly into the register Ra is outputted as it is.

In the fuel supply arrangement K3, when the temperature of the intake air at the time of starting of the engine 1 is higher than that at the time of stop of the engine 1 with a consequent possibility that the air temperature sensor 8 is subjected to time lag of detection, the injected amount of the fuel to the engine 1 is correctively controlled for a predetermined time period after starting of the engine 1 on the basis of, in place of the output delivered at that time from the air temperature sensor 8, the output having a fixed value delivered at the time of stop of the engine 1 from the air temperature sensor 8, so that such a phenomenon does not take place that the injected amount of the fuel to the engine 1 becomes insufficient due to excessive corrective control of the injected amount of the fuel to the engine 1. As a result, it becomes possible to prevent the air-fuel mixture from becoming excessively lean, thereby eliminating drop of output of the engine 1 or stop of the engine 1.

Figure 16:
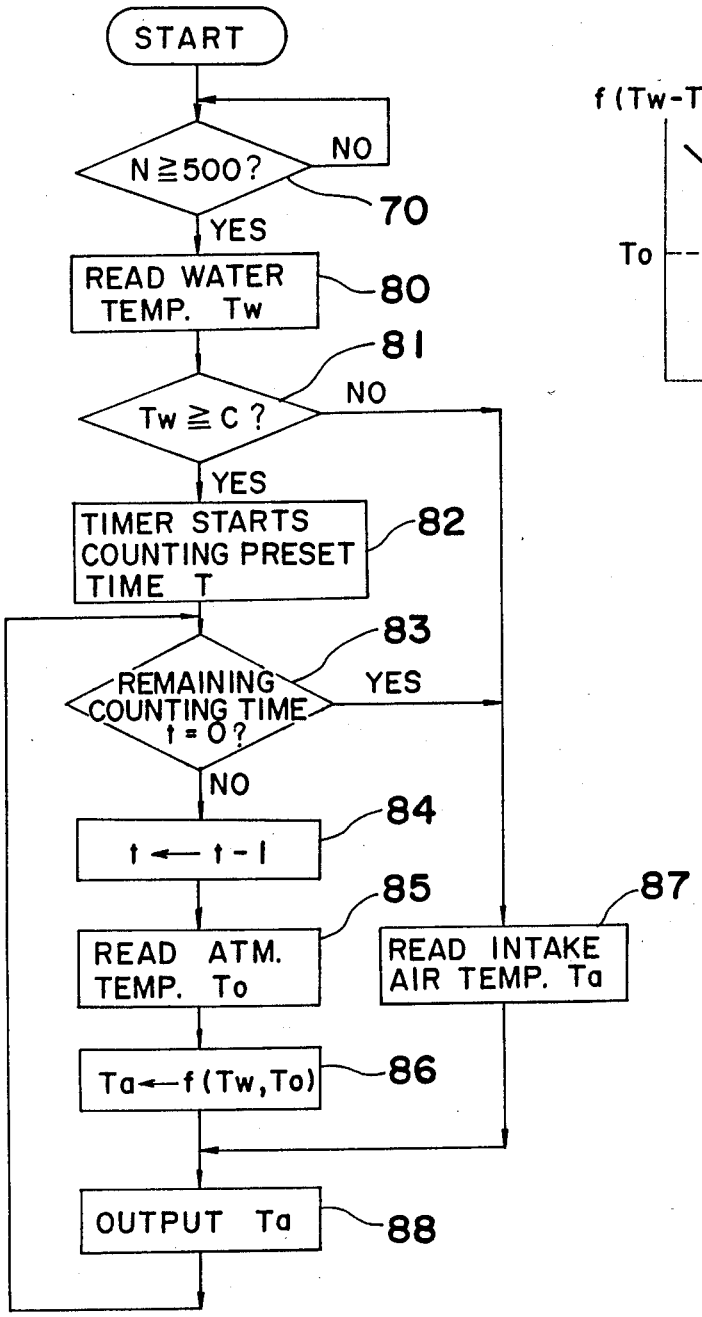
FIG. 16 is a flow chart similar to FIG. 15, particularly showing a modification thereof.

Meanwhile, it is so arranged in the third embodiment of the present invention that when the temperature of the intake air at the time of starting of the engine 1 is higher than that at the time of stop of the engine 1, the corrective control of the injected amount cf the fuel to the engine 1 on the basis of the output of the air temperature sensor 8 is cancelled. However, it can be also so arranged that the corrective control is cancelled upon detection of starting of the engine 1 having the high-temperature cooling water. FIG. 16 shows a modification of the third embodiment of the present invention, in which the corrective control is cancelled at the time of starting of the engine 1 having the high-temperature cooling water, i.e., starting of the engine 1 in the hot state. Hereinbelow, operations of the modified correction circuit 17 will be described with reference to the flow chart of FIG. 17. Initially, when an ignition signal of the ignition switch 9 is applied to the correction circuit 17, the correction circuit 17 decides whether or not the engine 1 has been started at step 70. In the case of "YES" at step 70, step 80 follows. At step 80, an output Tw of a water temperature sensor 7 (shown in the broken lines in FIGS. 13 and 14) for detecting water temperature of the cooling water of the engine 1 is read so as to be stored in a register Rw. Then, at step 81, a decision is made as to whether or not the content Tw of the register Rw is not less than a preset value C in order to determine whether or not the engine 1 is started in the hot state.

In the case of "YES" at step 81, step 82 follows at which a timer starts counting a present time T. Then, if it is found at step 83 that a remaining counting time t of the preset time T of the timer is not zero, one is subtracted from the remaining counting time t at step 84.

Figure 17:
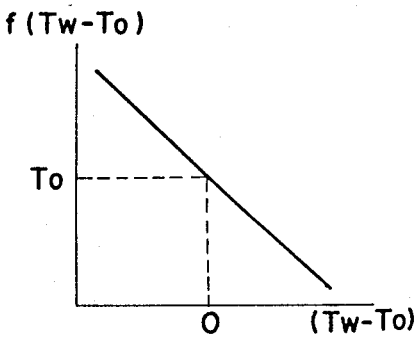
FIG. 17 is a graph explanatory of operation of the correction circuit of the control circuit of FIG. 14.

Thereafter, an analog to digital converted output To of an atmospheric temperature sensor 11 shown in the broken lines in FIGS. 13 and 14 is read so as to be stored in a register Ro at step 85. At step 86, a proper value Ta is determined, as a function f(Tw, To), from the contents To and Tw stored in the registers Ro and Rw, respectively. Then, at step 88, the content Ta of the register Ra is outputted as the output of the air temperature sensor 8. Subsequently, the program flow returns to step 83 so as to be repeated between steps 83 and 88. Meanwhile, the proper value Ta of step 86 is determined by, for example, using characteristics of a function f(Tw−To) relative to a value of (Tw−To) as shown in FIG. 17. Namely, the atmospheric temperature To corrected by the water temperature Tw may be employed as the proper value Ta of step 86. In the case of "YES" at step 83, step 87 follows. At step 87, the analog to digital converted output Ta of the air temperature sensor 8 is read so as to be stored in the register Ra. Then, the content Ta of the register Ra is outputted at step 88.

In the above described third embodiment and its modification of the present invention, it is so arranged that the engine operating condition where the temperature of the intake air at the time of starting of the engine 1 is higher than that at the time of stop of the engine 1 and starting of the engine 1 having the high temperarure cooling water are, respectively, detected as specific engine operating conditions where the corrective control of the injected amount of the fuel to the engine 1 on the basis of the output of the air temperature sensor 8 is cancelled. However, it can be also so arranged that engine operating conditions where the output of the air temperature sensor 8 assumes a value higher than the actual temperature of the intake air are detected as the specific engine operating conditions at the time of mere start of the engine 1 or acceleration of the engine 1.

Furthermore, in the third embodiment and its modification of the present invention, it is so arranged that in the specific engine operating condition, the injected amount of the fuel to the engine 1 is correctively controlled on the basis of, in place of the output delivered at that time from the air temperature sensor 8, the output delivered at the time of stop of the engine 1 from the air temperature sensor 8 or the atmospheric temperature To corrected by the water temperature Tw. However, it can be also so arranged that the corrective control in the specific engine operating condition is performed by using output of the air temperature sensor 8 in another engine operating condition, atmospheric temperature or a fixed value. Furthermore, it can be also so arranged that the corrective control is not performed at all in the specific engine operating condition.

As is clear from the foregoing description, in the fuel supply arrangement for the engine according to the third embodiment of the present invention, in which the air temperature sensor is provided in the intake passage of the engine such that the supply amount of the fuel to the engine is correctively controlled on the basis of the output of the air temperature sensor, the specific engine operating condition where the output of the air temperature sensor assumes a value higher than the actual temperature of the intake air is detected such that the corrective control of the supply amount of the fuel to the engine on the basis of the output of the air temperature sensor is cancelled in the specific engine operating condition. Accordingly, in accordance with the present invention, such a phenomenon does not take place that the amount of the fuel in the engine becomes insufficient due to excessive corrective control of the supply amount of the fuel to the engine. Thus, in accordance with the present invention, it becomes possible to prevent the air-fuel mixture from becoming excessively lean, thereby eliminating drop of the output of the engine or stop of the engine.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A fuel supply arrangement for an internal combustion engine, comprising:

an adjusting device for adjusting supply amount of fuel to said engine;

an air temperature sensor for detecting temperature of intake air, which is provided in an intake passage of said engine;

a correcting means for correctively controlling said adjusting device on the basis of an output of said air temperature sensor such that the supply amount of the fuel to said engine is decreased as the temperature of the intake air rises;

a detecting means for detecting a specific engine operating condition where a temperature of the intake air corresponding to the output of said air temperature sensor is higher than an actual temperature of the intake air; and a restricting means for restricting corrective control of said correcting means in response to a detection output of said detecting means, with the detection output representing detection of the specific engine operating condition.

2. A fuel supply arrangement as claimed in claim 1, wherein said detecting means includes a first detecting member fo detecting starting of said engine in a warmed-up state.

3. A fuel supply arrangement as claimed in claim 2, wherein said first detecting member includes a water temperature sensor for detecting temperature of cooling water of said engine.

4. A fuel supply arrangement as claimed in claim 3, wherein said restricting means restricts the corrective control of said correcting means in response to the output of said air temperature sensor.

5. A fuel supply arrangement as claimed in claim 2, wherein said first detecting member detects that a difference between an output delivered at the time of starting of said engine from said air temperature sensor and an output delivered immediately prior to latest stop of said engine from said air temperature sensor is not less than a predetermined value.

6. A fuel supply arrangement as claimed in claim 5, wherein said restricting means restricts the corrective control of said correcting means on the basis of a change rate of the temperature of the intake air.

7. A fuel supply arrangement as claimed in claim 1, wherein said detecting means includes a second detecting member for detecting a change rate of the output of said air temperature sensor.

8. A fuel supply arrangement as claimed in claim 7, wherein said restricting means includes a first cancelling means for cancelling the corrective control of said correcting means when the change rate is not less than a predetermined value.

9. A fuel supply arrangement as claimed in claim 8, wherein said correcting means correctively controls said adjusting means by using a fixed value when the corrective control of said correcting means is cancelled by said first cancelling means.

10. A fuel supply arrangement as claimed in claim 9, wherein an output delivered immediately prior to latest stop of said engine from said air temperature sensor is employed as the fixed value.

11. A fuel supply arrangement as claimed in claim 1, wherein said restricting means includes a cancelling means for cancelling the corrective control of said correcting means in the specific engine operating condition.

12. A fuel supply arrangement as claimed in claim 11, wherein said restricting means restricts the corrective control of said correcting means by using a fixed value when the corrective control of said correcting means is cancelled by said second cancelling means.

13. A fuel supply arrangement as claimed in claim 12, wherein an output delivered immediately prior to latest stop of said engine from said air temperature sensor is employed as the fixed value.

14. A fuel supply arrangement as claimed in claim 11, wherein said restricting means restricts the corrective control of said correcting means on the basis of atmospheric temperature when the corrective control of said correcting means is cancelled by said second cancelling means.

15. A fuel supply arrangement as claimed in claim 14, wherein the atmospheric temperature is corrected by temperature of cooling water of said engine.

16. A fuel supply arrangement as claimed in claim 1, further including an atmospheric temperature sensor for detecting atmospheric temperature, said detecting means including a detecting member for detecting a change rate of a difference between an output of said air temperature sensor and an output of said atmospheric temperature sensor.

17. A fuel supply arrangement as claimed in claim 16, wherein said restricting means includes a cancelling means for cancelling the corrective control of said correcting means when the change rate is not less than a predetermined value.

18. A fuel supply arrangement as claimed in claim 17, wherein said correcting means correctively controls said adjusting means by using a fixed value when the corrective control of said correcting means is cancelled by said third cancelling means.

19. A fuel supply arrangement as claimed in claim 18, wherein a output delivered immediately prior to latest stop of said engine from said air temperature sensor is employed as the fixed value.

20. A fuel supply arrangement as claimed in claim 16, wherein said restricting means restricts the corrective control of said correcting means on the basis of the atmospheric temperature.

21. A fuel supply arrangement as claimed in claim 20, wherein the atmospheric temperature is corrected by temperature of cooling water of said engine.

* * * * *